US005558535A

United States Patent [19]

Saka et al.

[11] Patent Number: 5,558,535

[45] Date of Patent: Sep. 24, 1996

[54] LOCKING CONSTRUCTION

[75] Inventors: Yuuji Saka, Yokkaichi; Kouichi Shirouzu, Toyota; Kazuyuki Shiraki, Toyota, all of Japan

[73] Assignee: Sumitomo Wiring Systems, Ltd, Yokkaichi City, Japan

[21] Appl. No.: 255,736

[22] Filed: Jun. 7, 1994

[30] Foreign Application Priority Data

Jun. 25, 1993 [JP] Japan ..... 5-034576 U

[51] Int. Cl.[6] ..... H01R 13/627

[52] U.S. Cl. ..... 439/357; 439/350

[58] Field of Search ..... 439/345, 350–352, 439/357, 358

[56] References Cited

U.S. PATENT DOCUMENTS 5,030,127 7/1991 Blasko et al. .

5,254,014 10/1993 Yagi et al. .

5,342,215 8/1994 Silbernagel et al. ..... 439/357

5,399,045 3/1995 Yoneda et al. ..... 439/352 X

*Primary Examiner*—Khiem Nguyen

*Attorney, Agent, or Firm*—Greenblum & Bernstein P.L.C.

[57] ABSTRACT

A locking projection is provided on a first electrical component. A locking portion is provided on a second electrical component. The locking portion includes an elastically deflectable flexible portion and a hook portion formed at a distal end of the flexible portion and engageable with the locking projection. A spring portion is provided on the second electrical component so as to be spaced a predetermined distance from the locking portion. When deflection of the flexible portion has reached a predetermined amount or more, the spring portion is depressed by the locking portion so as to be elastically deflected.

5 Claims, 4 Drawing Sheets

LOCKING CONSTRUCTION

BACKGROUND OF THE INVENTION

1. Field of the Invention

The present invention relates to a locking construction and more particularly to a locking construction for holding two electrical components such as a relay and a junction box or a relay box connected with each other. The locking construction allows engagement of the two electrical components to each other to be reliably and efficiently performed; prevents the two electrical components from being engaged with each other incompletely; and prevents the connection performance between the two electrical components from being deteriorated by external forces or vibrations applied thereto.

2. Description of the Related Arts

FIG. 1 shows an example of a locking construction for locking a relay 2 to a relay box 1.

Each terminal-accommodating chamber 3*a* is formed in a housing 3 of the relay box 1 and accommodates female terminals 4.

The relay 2 comprises a cylindrical engaging portion 2*a* which can fit around the housing 3 of the relay box 1. A pair of male terminals 5 is projectingly formed inside the engaging portions 2*a*.

In connecting the relay 2 with the relay box 1, the housing 3 is inserted into the engaging portion 2*a* of the relay 2 so as to press the male terminals 5 into the female terminals 4. The relay 2 is locked to the relay box 1 by contact pressure between the male terminals 5 and the female terminals 4.

In the construction for locking the relay 2 to the relay box 1 by only the contact pressure between the male terminals 5 and the female terminals 4, when an operator engages the relay 2 with the housing 3 of the relay box 1, the operator feels a resistance force in pressing the male terminal 5 into the female terminals 4. However, there is no mechanism to allow the operator to feel that the operator has pressed the relay 2 to the predetermined position. In addition, a locking sound is not generated when the relay 2 has engaged the relay box 1 completely. Thus, it is necessary for the operator to visually check whether the relay 2 has engaged the relay box 1 completely. Hence, it is difficult to perform an engaging operation efficiently.

There is also a possibility that the operator may terminate the engaging operation, with the relay 2 not completely engage with the relay box 1 because of the above-described reason.

Further, even though the relay 2 is in complete engagement with the relay box 1, there is a possibility that the relay 2 and the relay box 1 become disengaged from each other. That is, the capability of keeping the connection between the relay 2 and the relay box 1 deteriorates when external forces or vibrations are applied to the relay 2 and the relay box 1 connected with each other by only the contact pressure between the male terminals 5 and the female terminals 4.

SUMMARY OF THE INVENTION

It is accordingly a first object of the present invention to provide a locking construction which allows the operation of engaging two electrical components with each other to be reliably and efficiently performed.

It is a second object of the present invention to provide a locking construction which prevents two electrical components from being incompletely engaged with each other.

It is a third object of the present invention to provide a locking construction which prevents the connection performance between two electrical components from being deteriorated by external forces or vibrations applied thereto.

In accomplishing these and other objects, there is provided a locking construction for holding first and second electrical components electrically connected to each other, comprising; a locking projection which is provided on the first electrical component; a locking portion, which is provided on the second electrical component and includes an elastically deflectable flexible portion and a hook portion formed at a distal end of the flexible portion and engageable with the locking projection; and a spring portion which is provided on the second electrical component so as to be spaced a predetermined distance from the locking portion; wherein when deflection of the flexible portion has reached a predetermined amount or more, the spring portion is depressed by the locking portion so as to be elastically deflected.

According to the above-described construction, when the deflection of the flexible portion exceeds a predetermined amount or more, the spring portion is deflected by the flexible portion being depressed. When the locking projection has moved past the hook portion, i.e., when the two electrical components have engaged each other completely, the configuration of the flexible portion and that of the spring portion are elastically returned to the undeflected configuration. Therefore, a loud locking sound is generated when the hook portion has collided with the second electrical component. An operator can feel clearly that the operator has pressed the first electrical component to the predetermined position. That is, the elastic force generated by the deflection of the locking portion and that of the spring portion is instantaneously removed. Therefore, the operator can confirm that the engaging operation has been completed.

Further, when the two electrical components have engaged each other, the hook portion is in engagement with the locking projection formed on the first electrical component. Accordingly the two electrical components are reliably locked by the locking construction.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
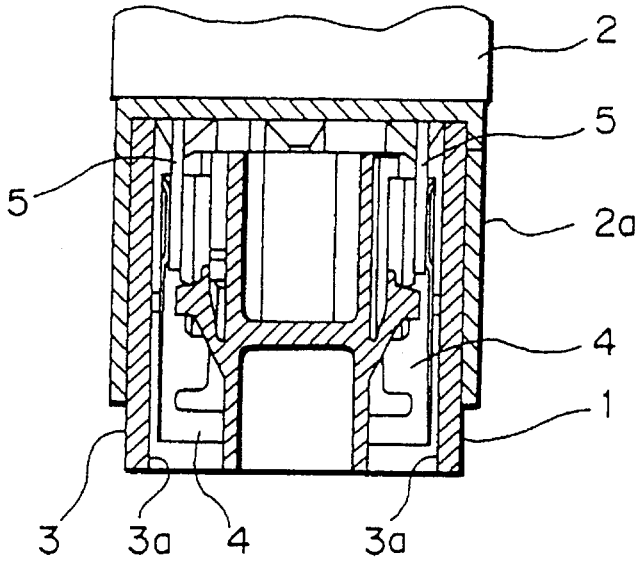
Fig. 1 PRIOR ART
FIG. 1 is a schematic view showing an example of a conventional locking construction.

Before the description of the present invention proceeds, it is to be noted that like parts are designated by like reference numerals throughout the accompanying drawings.

A locking construction according to an embodiment of the present invention is described below with reference to the drawings.

Figure 2:
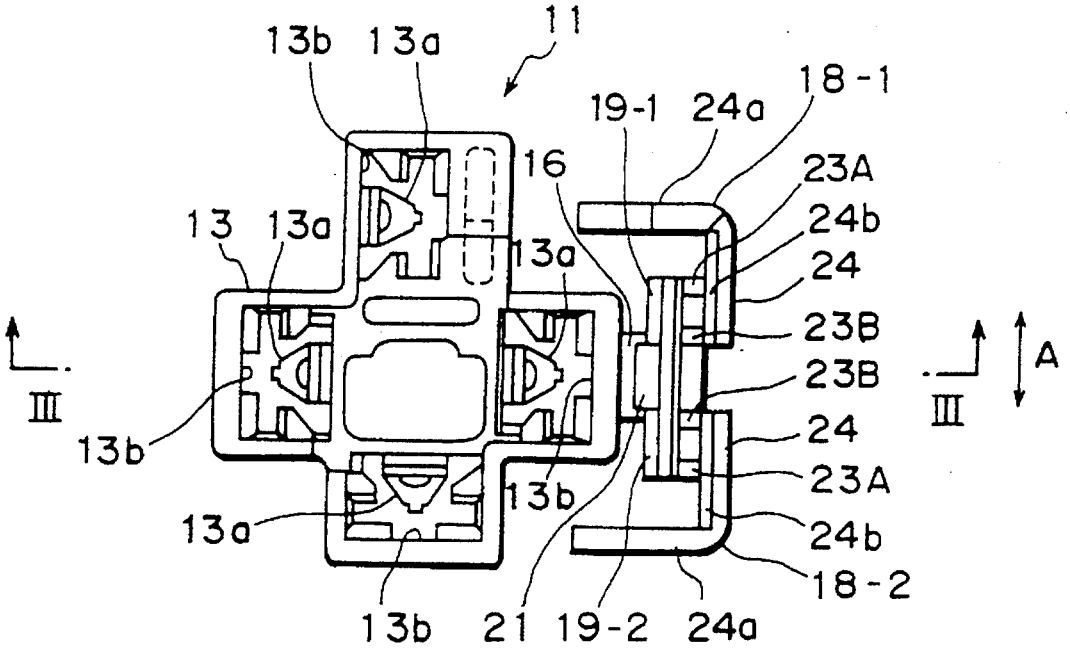
FIG. 2 is a plan view showing a relay box according to an embodiment of the present invention.
Figure 3:
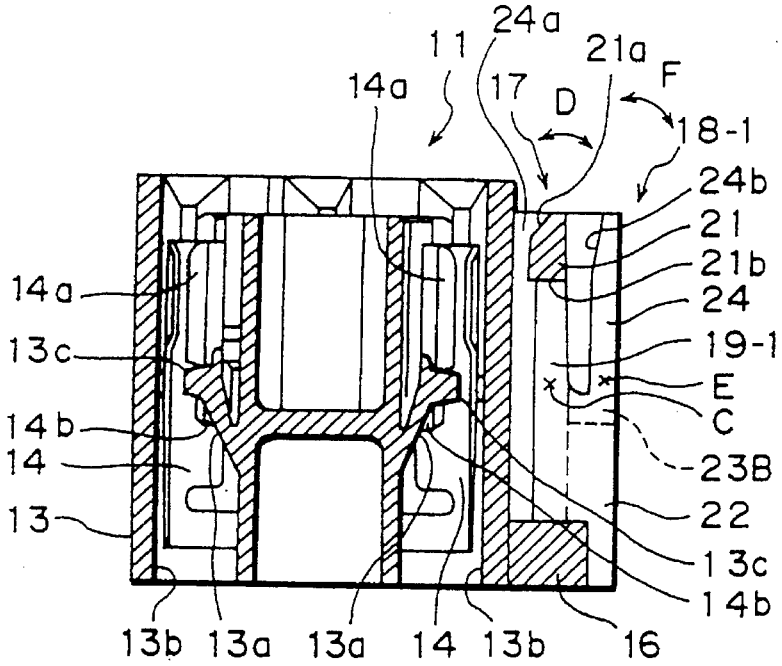
FIG. 3 is a sectional view, showing the relay box of FIG. 1, taken along a line III—III of FIG. 2.
Figure 4:
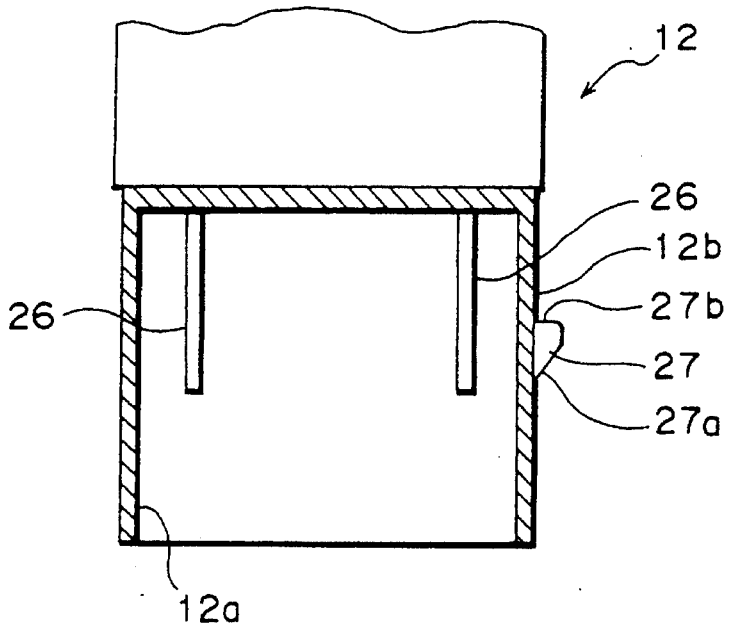
FIG. 4 is a partially sectional schematic view partially sectional showing a relay according to the embodiment of the present invention.

The locking construction is used to engage a relay 12 shown in FIG. 4 with a relay box 11 shown in FIGS. 2 and 3 so as to hold the relay 12 in the relay box 11.

The relay box 11 is made of resin. A housing main body 13 of the relay box 11 accommodates a plurality of terminal-accommodating chambers 13*b*, each accommodating a lance 13*a*.

A female terminal 14, shown only in FIG. 3, to be accommodated in each terminal-accommodating chamber 13*b* has a contact portion 14*a* to be pressed against a male terminal 26 of the relay 12. Each female terminal 14 has an engaging hole 14*b* which engages a projection 13*c* formed on the top end of the lance 13*a* so as to hold the female terminal 14 in the terminal-accommodating chamber 13*b*.

A rectangular plate-shaped base portion 16 integral with the housing main body 13 is formed in the right lower end of the housing main body 13 in FIG. 3. A locking portion 17 is formed on the base portion 16. Spring portions 18-1 and 18-2 are adjacent to the locking portion 17.

The locking portion 17 comprises a pair of plate-shaped flexible portions 19-1 and 19-2 projecting upward in FIG. 3. The flexible portions 19-1 and 19-2 are spaced at an interval in the widthwise direction (direction shown by arrow A (FIG. 2) of the base portion 16. A hook-shaped portion 21 integral with the top ends of the flexible portions 19-1 and 19-2 is interposed therebetween.

The hook portion 21 comprises an inclined surface 21*a* formed on the upper surface thereof and inclined upward toward the right in FIG. 3; and a locking surface 21*b* which is flat and substantially perpendicular to the the flexible portion 19-1 and 19-2.

The lower portions (in FIG. 3) of the flexible portions 19-1 and 19-2 are integral with the spring portions 18-1 and 18-2, respectively, through a side wall 22. The flexible portions 19-1 and 19-2 are elastically deflected in a direction shown by an arrow (D) on a point (shown by (C)) corresponding to the upper end of the side wall 22.

The spring portions 18-1 and 18-2 comprise a first coupling portion 23A and a second coupling portion 23B, respectively, projecting therefrom in the lateral direction in FIG. 3 opposite to the housing main body 13 from the flexible portions 19-1 and 19-2 of the locking portion 17. Each of the spring portions 18-1 and 18-2 further comprises a spring main body 24 projecting upward in FIG. 3 in parallel with the flexible portions 19-1 and 19-2 from each of the first and second coupling portions 23A and 23B. The spring main bodies 24 are spaced at a predetermined interval from the locking portion 17.

A pair of rib portions 24*a* extends in the length-wise direction of the base plate 16 such that the rib portions 24*a* sandwich the base plate 16, as shown in FIG. 2. The upper portion of each spring main body 24 is thinner than the lower portion thereof to form a tapered portion 24*b* on the upper portion thereof, as shown in FIGS. 2 and 3.

The lower portion of the first coupling portion 23A and that of the second coupling portion 23B are integral with each of the flexible portions 19-1 and 19-2 through the side wall 22. Each spring main body 24 is elastically deflected on a connecting point (shown by (E) in FIG. 3) of the first and second coupling portions 23A and 23B in a direction shown by an arrow (F) of FIG. 3.

Referring to FIG. 4, the relay 12 comprises an engaging portion 12*b* including a open portion 12*a* into which the housing main body 13 of the relay box 11 is inserted. The male terminals 26 are projectingly formed inside the engaging portion 12*b*. A locking projection 27 extends outward from a peripheral surface of the engaging portion 12*b*.

The locking projection 27 comprises an inclined surface 27*a* forming the lower end surface thereof and a flat locking surface 27*b* forming the upper surface thereof. The locking surface 27*b* is substantially perpendicular to the peripheral surface of the engaging portion 12*b*.

The operation of engaging the relay 12 with the relay box 11 is described below.

Figure 5:
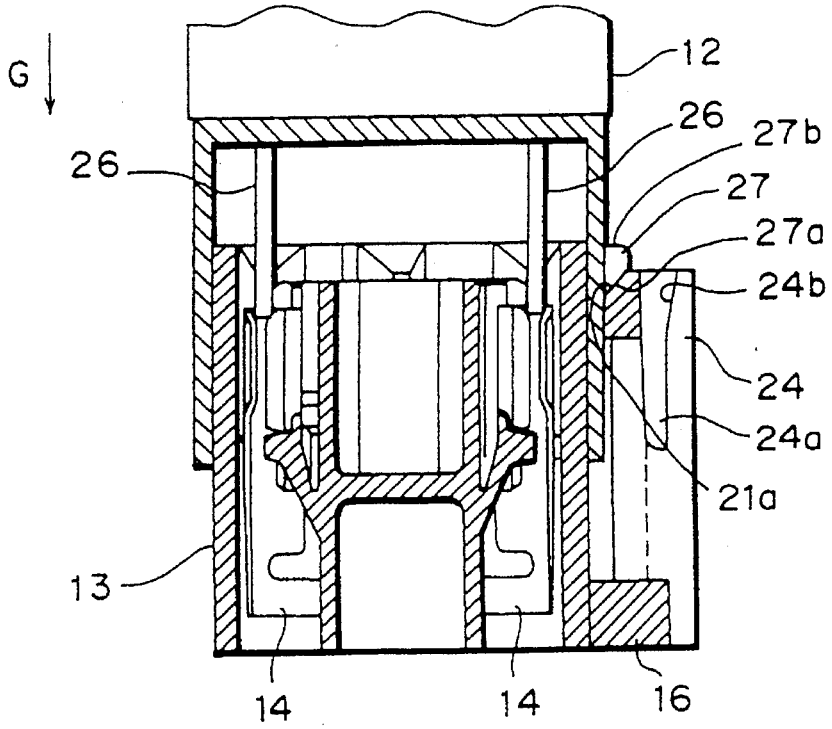
FIG. 5 is a schematic view for describing an initial state of an operation of engaging the relay with the relay box according to the embodiment of the present invention.

Referring to FIG. 5, the engaging portion 12*b* of the relay 12 is pressed in a direction shown by an arrow (G), with the housing main body 13 of the relay box 11 inserted into the engaging portion 12*b*. As an operator presses the relay 12 in the above-described direction, the male terminal 26 of the relay 12 is pressed into the contact portion 14*a* of the female terminal 14. At this time, because the inclined surface 27*a* of the locking projection 27 of the relay 12 engages the inclined surface 21*a* of the hook portion 21 of the locking portion 17, the flexible portions 19-1 and 19-2 of the locking portion 17 are elastically deflected outward as the operator presses the relay 12 further in the above-described direction. That is, the operator presses the relay 12 toward the relay box 11 against the resistance force generated in pressing the male terminal 26 against the female terminal 14 and the elastic force generated by the deflection of the locking portion 17.

When the deflection of the flexible portions 19-1 and 19-2 exceeds a predetermined amount or more, the flexible portions 19-1 and 19-2 overlap on the spring portions 18-1 and 18-2, respectively, thus pressing the latter. As a result, the spring portions 18-1 and 18-2 are deflected outward by the flexible portions 19-1 and 19-2 being deflected.

Figure 6:
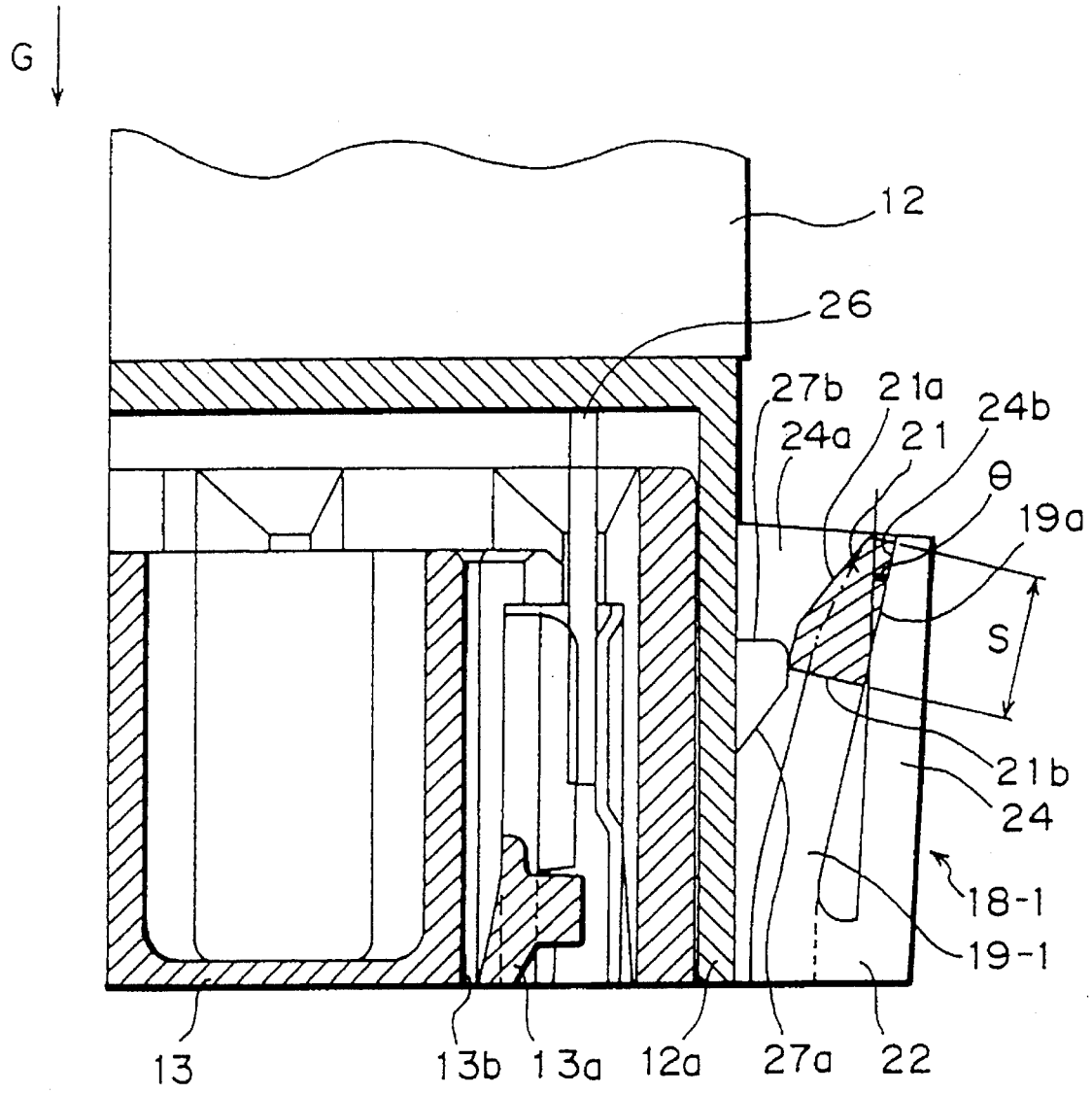
FIG. 6 is a partially enlarged view showing an intermediate state of the operation of engaging the relay with the relay box according to the embodiment of the present invention.

FIG. 6 shows a state in which the flexible portions 19-1 and 19-2 have been deflected outward in the greatest extent. At this time, the outer surface 19*a* of the flexible portions 19-1 and 19-2 overlap on the tapered portion 24*b* of each spring main body 24 in an overlap range (S). As a result, the spring main body 24 is deflected outward by the flexible portions 19-1 and 19-2 being deflected. The operator feels the greatest resistance force in the state shown in FIG. 6.

Figure 7:
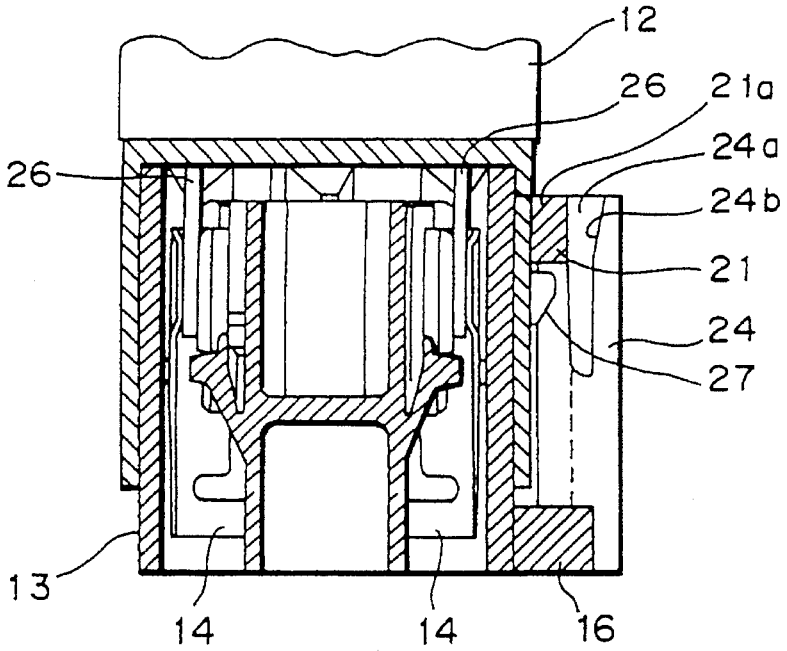
FIG. 7 is a schematic view showing a completion state of the operation of engaging the relay with the relay box according to the embodiment of the present invention.

When the operator has pressed the relay 12 further in the direction shown by the arrow (G) in this state, the locking projection 27 moves past the hook portion 21 of the locking portion 17. As a result, the flexible portions 19-1 and 19-2 which have been elastically deflected outward are returned instantaneously to the undeflected configuration as shown in FIG. 7, and the hook portion 21 collides with the outer surface of the engaging portion 12*b* of the relay 12, thus generating a locking sound. In the state in which the flexible portions 19-1 and 19-2 are deflected in the greatest extent, the spring main body 24 is also deflected elastically. When the locking projection 27 has moved past the hook portion 21 of the locking portion 17, the spring main body 24 is instantaneously returned to the undeflected configuration shown in FIG. 7.

A loud sound is generated when the hook-shaped portion 21 has collided with the engaging portion 12*b* of the relay 12 because the colliding occurs not only by the elastic force forcing the flexible portions 19-1 and 19-2 to return to the unflexed state but also by the elastic force forcing spring main body 24 to the unflexed state. The locking sound enables the operator to confirm that the relay 12 has completely engaged the relay box 11.

When the locking projection 27 has moved past the hook portion 21, the elastic force generated by the flexure of the locking portion 17 and that of the spring portions 18-1 and 18-2 are instantaneously removed. Thus, when the operator has completely engaged the relay 12 with the relay box 11, the operator can feel clearly that the operator has pressed the relay 12 to the predetermined position, which allows the operator to confirm that the engaging operation has been completed.

According to this embodiment, as described above, the operator can confirm that the operator has connected the male terminal 26 and the female terminal 14 with each other by completely engaging the former with the latter. Thus, the operator can perform the engaging operation efficiently and prevent the relay 12 from incompletely engaging the relay box 11.

In this embodiment, the elastic resistance force generated by the flexure of the flexible portions 19-1 and 19-2 and that of the spring main body 24 can be differentiated from each other by varying an angle θ formed between the tapered portion 24*b* and a vertical line. That is, if the angle θ is set to be small to make the inclination of the tapered portion 24*b* steep, the overlap range (S) becomes large and thus the resistance force becomes great, whereas if the angle θ is set to be large to make the inclination of the tapered portion 24*b* gentle, the overlap range (S) becomes small and thus the resistance force becomes small. That is, in this embodiment, the degree of the operator's sense that the operator has pressed the relay 12 to the predetermined position and that of the locking sound can be adjusted by appropriately setting the angle θ in engaging the relay 12 with the relay box 11.

As described above, the spring main body 24 of each of the spring portions 18-1 and 18-2 is spaced from the locking portion 17 at a predetermined interval. Therefore, the operator can press the relay 12 toward the relay box 11 against only the elastic force generated by the deflection of the locking portion 17 until the locking portion 17 is deflected more than a predetermined amount. That is, the operator can clearly feel that the operator has pressed the relay 12 to the predetermined position and hear the locking sound and moreover, a comparatively small force is sufficient for the operator to engage the relay 12 with the relay box 11.

When the locking projection 27 has moved past the hook portion 21, the locking surface 27*b* of the locking projection 27 engages the locking surface 21*b* of the hook-shaped portion 21. As a result, the relay 12 is locked to the relay box 11, with the former engaging the latter. Accordingly, even though external forces or vibrations are applied to the relay 12 and the relay box 11, the relay 12 can be reliably locked to the relay box 11. That is, the connection performance of the locking construction does not deteriorate.

It is possible to modify the locking construction according to the above-described embodiment.

For example, the locking construction may be used to connect the relay with a junction box.

As is apparent from the foregoing description, according to the present invention, the locking projection is formed on the first electrical component. The second electrical component is provided with the locking portion comprising the hook portion, engaging the locking projection, formed on the end of the flexible portion which is elastically deflected. The second electrical component is further provided with the spring portion which is elastically deflected. In engaging the first electrical component with the second electrical component, the locking projection is brought into contact with the hook portion, thus elastically deflecting the flexible portion. When the deflection of the flexible portion exceeds a predetermined amount or more, the spring portion is depressed by the flexible portion being deflected. When the locking projection has moved past the hook portion, i.e., when the two electrical components have completely engaged each other, the configuration of the flexible portion and that of the spring portion are elastically returned to the undeflected position. Therefore, a loud locking sound is generated when the hook portion has collided with the other electrical equipment. The locking sound enables an operator to confirm that the two electrical components have engaged each other.

When the locking projection has moved past the hook portion, the resistance force generated in engaging the two electrical components, namely, the elastic force generated by the deflection of the locking portion and that of the spring portion, is instantaneously removed. Therefore, the operator can clearly feel that the operator has pressed one electrical equipment to the predetermined position, which allows the operator to confirm that the engaging operation has been completed.

According to this embodiment, the operator can confirm that the operator has connected the male and female terminals with each other by completely engaging the two electrical equipments with each other. Thus, the operator can efficiently perform the engaging operation and prevent the first electrical component from engaging the second electrical equipment incompletely.

The locking construction locks the electrical component engaged to each other by means of the engagement between the locking projection and the hook portion formed on the end of the flexible portion. Accordingly, even though external forces or vibrations are applied to the two electrical components, they are kept engaged with each other, with the male and female terminals connected with each other. That is, the connection performance of the male and female terminals does not deteriorate.

The spring portions are spaced from the locking portion at a predetermined interval. Therefore, the operator can press the first electrical component toward the second electrical equipment against only the elastic force generated by the flexure of the locking portion until the locking portion is deflected more than a predetermined amount. That is, a comparatively small force is sufficient for the operator to engage the two electrical equipments with each other, though the operator can clearly feel that the operator has pressed one electrical equipment to the predetermined position and hear the locking sound.

Although the present invention has been fully described in connection with the preferred embodiments thereof the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A locking construction for holding first and second electrical components into electrical connection with each other, the locking construction comprising:

a locking projection being provided on the first electrical component;

a locking portion being provided on the second electrical component, the locking portion including an elastically deflectable flexible portion and a hook portion formed at a distal end of the flexible portion and engageable with the locking projection; and a spring portion being provided on the second electrical component so as to be spaced a predetermined distance from the locking portion;

wherein when deflection of the flexible portion by the locking projection has reached at least a predetermined amount, the spring portion is depressed by the locking portion so as to be elastically deflected, the predetermined amount being before the first and second electrical components are held in electrical connection with each other, the flexible portion being returned to an undeflected position and the hook portion contacting the first electrical component when the first and second electrical components are in electrical connection with each other.

2. A locking construction for holding first and second electrical components accommodating male and female terminals, respectively, and being engaged with each other so as to connect a male terminal of the first electrical component and a female terminal of the second electrical component to each other, the locking construction comprising:

a locking projection being provided on a side wall of the first electrical component;

a locking portion being provided on a side wall of the second electrical component, the locking portion including a base portion projecting from a lower end of the second electrical component in a lateral direction, a pair of flexible portions projecting upwardly from the base portion and a hook portion coupling ends of respective flexible portions with each other;

a spring portion including a coupling portion projecting from the flexible portions substantially in a lateral direction, and a main body portion in parallel with the flexible portions;

wherein when deflection of the flexible portions by the locking projection has reached at least a predetermined amount, the spring portion is depressed by the locking portion so as to be elastically deflected, the predetermined amount being before the first and second electrical components are completely engaged with each other, the flexible portions being returned to an undeflected position and the hook portion contacting the side wall of the first electrical component when the first and second electrical components are completely engaged with each other.

3. The locking construction as defined in claim 2, wherein a taper portion is provided at a distal end of the main body portion of the spring portion.

4. A locking construction for holding an engaging portion of a relay fitted around a housing of a relay box such that a male terminal accommodated in the relay and a female terminal accommodated in the relay box are connected to each others the locking construction comprising:

a locking projection being provided at an outside of the engaging portion of the relay;

a locking portion being provided in a side wall of the housing, the locking portion including a base portion projection from a lower end of the side wall of the housing in a lateral direction, a pair of flexible portions projecting upwardly from the base portion, and a hook portion coupling respective ends of the flexible portions with each other; and a spring portion including a coupling portion projecting from the flexible portions substantially in a lateral direction, and a main body portion projecting upwardly from an end of the coupling portion in parallel with the flexible portions;

wherein when deflection of the flexible portions by the locking projection has reached at least a predetermined amount, the spring portion is depressed by the locking portion so as to be elastically deflected, the predetermined amount being before the engaging portion of the relay and the housing are completely engaged with each other, the flexible portions being returned to an undeflected position and the hook portion contacting the side wall of the housing when the engaging portion of the relay and the housing are completely engaged with each other.

5. The locking construction as defined in claim 4, wherein a taper portion is provided at a distal end of the main body portion of the spring portion.

* * * * *

UNITED STATES PATENT AND TRADEMARK OFFICE

CERTIFICATE OF CORRECTION

PATENT NO. : 5,558,535

DATED : September 24, 1996

INVENTOR(S) : Y. SAKA et al.

It is certified that error appears in the above-indentified patent and that said Letters Patent is hereby corrected as shown below:

At column 8, line 16 (claim 4, line 5), change "others" to ---other,---.

Signed and Sealed this

Twenty-eighth Day of January, 1997

*Attest:*

Bruce Lehman

BRUCE LEHMAN

*Attesting Officer*

*Commissioner of Patents and Trademarks*